US005681258A

United States Patent [19]

Lowe et al.

[11] Patent Number: 5,681,258

[45] Date of Patent: Oct. 28, 1997

[54] CENTRIFUGE ROTOR WITH FREE-FLOATING INTERLOCKING TRUNNION PINS

[75] Inventors: Winston H. H. Lowe, Sunnyvale; Sal Castiglia; Luis R. Ramirez, Jr., both of San Jose, all of Calif.

[73] Assignee: Beckman Instruments, Inc., Fullerton, Calif.

[21] Appl. No.: 787,550

[22] Filed: Jan. 22, 1997

[51] Int. Cl.[6] ..... B04B 5/02

[52] U.S. Cl. ..... 494/20

[58] Field of Search ..... 494/12, 20, 33, 494/83, 85; 74/572

[56] References Cited

U.S. PATENT DOCUMENTS

| | | | |
|---|---|---|---|
| 3,028,075 | 4/1962 | Blum | 494/20 |
| 3,266,718 | 8/1966 | Stahl et al. | 494/20 |
| 3,722,791 | 3/1973 | Wright . | |
| 4,009,824 | 3/1977 | Wright . | |
| 4,147,294 | 4/1979 | Davidson et al. . | |
| 4,314,662 | 2/1982 | Uchida . | |
| 4,314,663 | 2/1982 | Ouchi . | |
| 4,344,563 | 8/1982 | Romanauskas . | |
| 4,548,596 | 10/1985 | Sutton, III et al. | 494/20 |
| 5,527,257 | 6/1996 | Piramoon . | |

FOREIGN PATENT DOCUMENTS

| | | | |
|---|---|---|---|
| 2900121 | 7/1980 | Germany | 494/20 |

*Primary Examiner*—Charles E. Cooley

*Attorney, Agent, or Firm*—William H. May; P. R. Harder; Thomas Schneck

[57] ABSTRACT

A swinging bucket centrifuge rotor having free-floating trunnion pins with each pair of trunnion pins having an interlocking mechanism disposed therebetween. The rotor includes a yoke having an axis of rotation, a plurality of spaced arms extending radially outward from the axis of rotation, each of which terminates in a bulwark. The bulwark includes a pair of intersecting bores, each of which extends along an axis lying in a plane spreading transverse to the axis of rotation. Each of the trunnion pins has a lengthwise axis and is disposed in one of the pair of intersecting bores. The trunnion pins include trunnion and coupling portions. The coupling portion has a surface. The interlocking mechanism includes a recess formed into the surface of the coupling portion and a coupling pin. The recess of each of trunnion pin of the pair of trunnion pins is superimposed upon the recess of the remaining trunnion pin, forming a chamber. The coupling pin is disposed within the chamber and is adapted to rest within the recess of each of the pair of trunnion pins, thereby preventing translational motion of each of said pair of trunnion pins in a direction perpendicular to the axis of rotation.

20 Claims, 4 Drawing Sheets

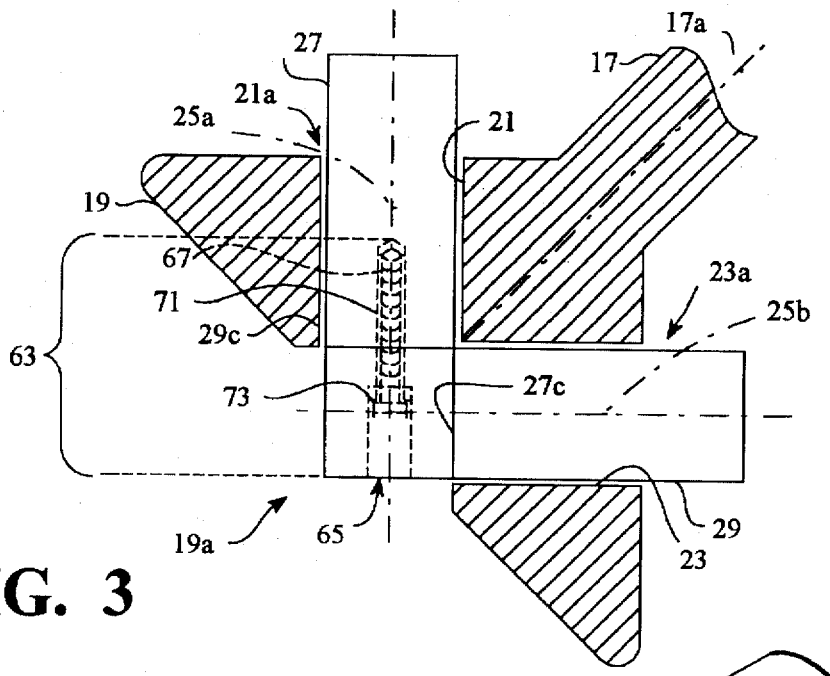
FIG. 3
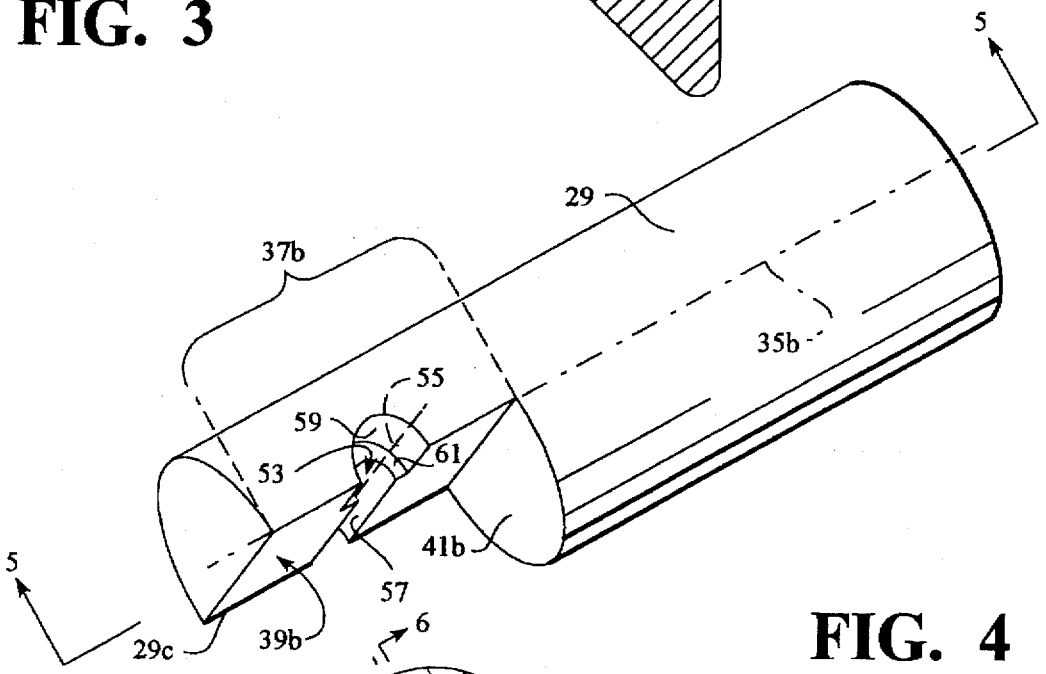
FIG. 4
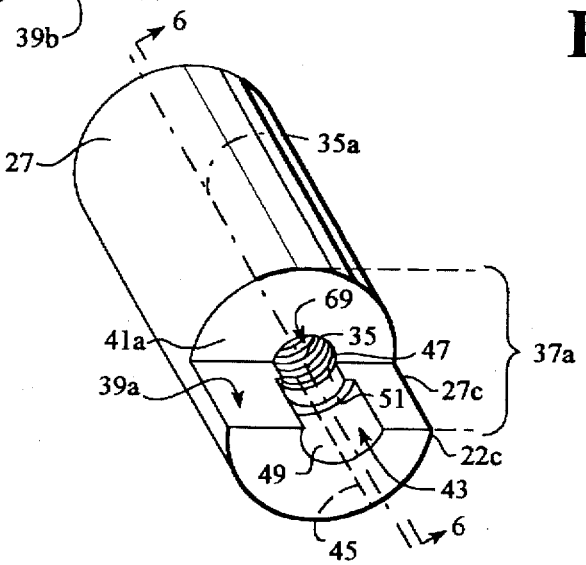

CENTRIFUGE ROTOR WITH FREE-FLOATING INTERLOCKING TRUNNION PINS

TECHNICAL FIELD

The present invention pertains to the field of centrifuge rotors. Specifically, the present invention pertains to a swinging bucket centrifuge rotor having removable trunnions.

BACKGROUND ART

Swinging bucket centrifuge rotors are well known in the art. Generally, they include a plurality of arms extending radially from a yoke. Each arm terminates in a plurality of support structures that are spaced apart in a circumferential direction. A pair of trunnions extends from each support structure in opposing directions. In this fashion, each trunnion extends toward a trunnion in an adjacent support structure, forming pairs of opposed trunnions. Each swinging bucket is disposed between adjacent support structures and is supported by a pair of opposed trunnions.

Two well known designs for swinging bucket centrifuge rotors include rotors having integral trunnion pins and rotors having separable trunnion pins. Rotors with integral trunnions are relatively expensive to manufacture. Prior rotors with removable trunnion pins have generally necessitated the use of special mounting tools which greatly increase the cost and complexity of the system.

An example of a swinging bucket centrifuge rotor employing removable trunnion pins is disclosed in U.S. Pat. No. 3,722,791 to Wright. Each arm includes a plurality of intersecting holes. A centerline of each of the center holes lies in a common plane that extends perpendicular to an axis of rotation of the rotor. A pair of trunnion pins intersect in the openings. One end of each of the pins extends beyond the surface of the arms, whereby the pin ends of adjacent arms form a trunnion. Each pin includes a cylindrical body that is stepped at one end, defining a shoulder and a flat surface. The pins are arranged so that the flat surfaces of each intersect, with the shoulder of each pin resting against a side edge of the remaining pin. A problem with this arrangement is that the placement of the pins within the rotor arm is not secure which makes them susceptible to de-coupling from the arm when the rotor is at rest.

U.S. Pat. No. 4,009,824 to Wright discloses another swinging bucket centrifuge rotor employing removable trunnions. Each arm includes a single opening near the outer end, perpendicular to a longitudinal axis of the arm. A trunnion pin is inserted through the opening and includes arcuately oriented opposite extremities functioning as trunnions. The arcuate design of the trunnion pins necessitates an increase in the diameter of the opening through which the trunnion pins extend, thereby weakening the rotor arm.

U.S. Pat. No. 4,314,662 to Uchida discloses yet another swinging bucket centrifuge rotor with removable trunnion pins. The rotor includes, in pertinent part, a pair of threaded bores extending from the end of each arm. The threaded bores are disposed on opposite sides of a centerline of the arm and extend, therefrom, outwardly in opposing directions. The axis of each threaded bore extends perpendicular to a longitudinal axis of the arm and parallel to a rotation axis of a swinging bucket. The trunnion pins include a first end having a plurality of threads complementary to the threaded bores, with the remaining end forming a smooth cylinder portion. The threaded end of each trunnion pin is fitted into one of the threaded bores. The buckets are hung between the smooth cylinder portions of opposed trunnion pins extending from adjacent arms. The direction of the threads of the opposed trunnions are in opposite directions so that the trunnion pins tighten when the buckets swing under centrifugal force.

U.S. Pat. No. 4,314,663 to Ouchi discloses a swinging bucket centrifuge rotor that includes, in pertinent part, a through opening formed at the end of each arm, with a holding shaft disposed therein. The holding shaft includes two opposed threaded bores each of which is orientated 45° with respect to a longitudinal axis of the arm. The trunnion pins include a first end having a plurality of threads complementary to the threaded bores, with the remaining end forming a smooth cylinder portion. The threaded end of each trunnion pin is fitted into one of the threaded bores. The buckets are hung between the smooth cylinder portions of opposed trunnion pins extending from adjacent arms. The direction of the threads of the opposed trunnions are in opposite directions so that the trunnion pins tighten when the buckets swing under centrifugal force. Having the threads wind in opposite directions, however, causes the trunnions to over-tighten, thereby making disassembly of the trunnions from the rotor difficult.

It is an object, therefore, of this invention to provide a swinging bucket centrifuge rotor having removable trunnion pins that reduces unintentional decoupling of the trunnion pins from the rotor while avoiding over-tightening of the same during centrifugation.

SUMMARY OF THE INVENTION

This object has been achieved by providing a swinging bucket centrifuge rotor having free-floating trunnion pins with an interlocking mechanism disposed between the trunnion pins. The rotor includes a yoke having an axis of rotation and a plurality of spaced arms extending radially outward from the axis of rotation. Each arm terminates in a bulwark. The bulwark includes a pair of intersecting bores, each of which extends along an axis lying in a plane spreading transverse to the axis of rotation. The pair of bores in each bulwark is aligned with one bore in an adjacent bulwark. A pair of trunnion pins is associated with each bulwark. Each of the trunnion pins has a lengthwise axis and is disposed in one of the pair of intersecting bores. The trunnion pins include trunnion and coupling portions. The trunnion portion extends outwardly from the bore toward a trunnion portion of an adjacent trunnion pin disposed in a bore of an adjacent bulwark. The coupling portion has a planar surface and a shoulder extending transverse thereto. The interlocking mechanism includes an arcuate recess formed into the planar surface and a coupling pin. The recess extends along a longitudinal axis. Upon being placed in a bulwark, the recesses of both trunnion pins are superimposed, forming a chamber. The coupling pin is disposed within the chamber and is adapted to rest within the recess of each of the pair of trunnion pins. In this fashion, an interlocking mechanism is formed, preventing translational motion of each of the pair of trunnion pins in a direction parallel to the axis of the bore associated therewith.

In one embodiment, one of the trunnion pins includes a threaded bore, and the coupling pin includes a threaded portion adapted to fit within the threaded bore. In another embodiment the coupling pin has an untextured surface and is gravity biased to prevent the aforementioned translational motion.

BRIEF DESCRIPTION OF THE DRAWINGS

FIG. 3 is an enlarged top down cross-sectional view of a bulwark and associated trunnion pins shown in FIG. 2.

FIG. 4 is an exploded perspective view of the trunnion pins shown in FIG. 3.

BEST MODE FOR CARRYING OUT THE INVENTION

Figure 1:
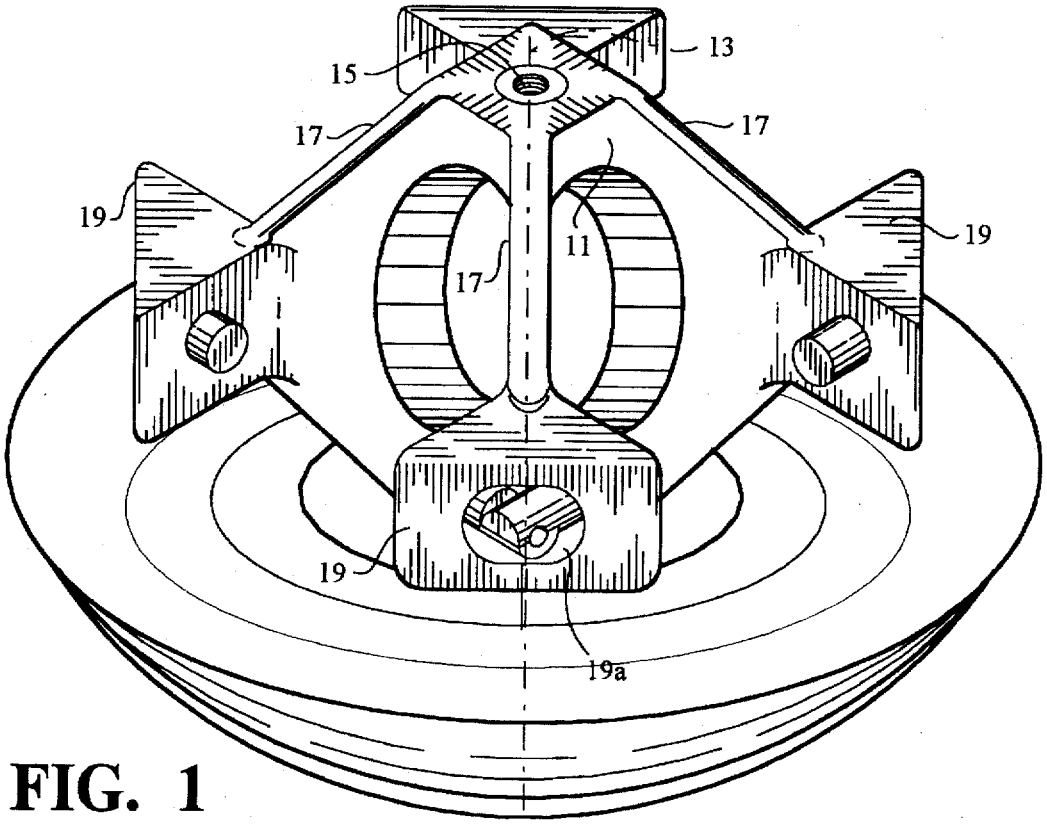
FIG. 1 is a perspective view of a rotor in accord with the present invention.
Figure 2:
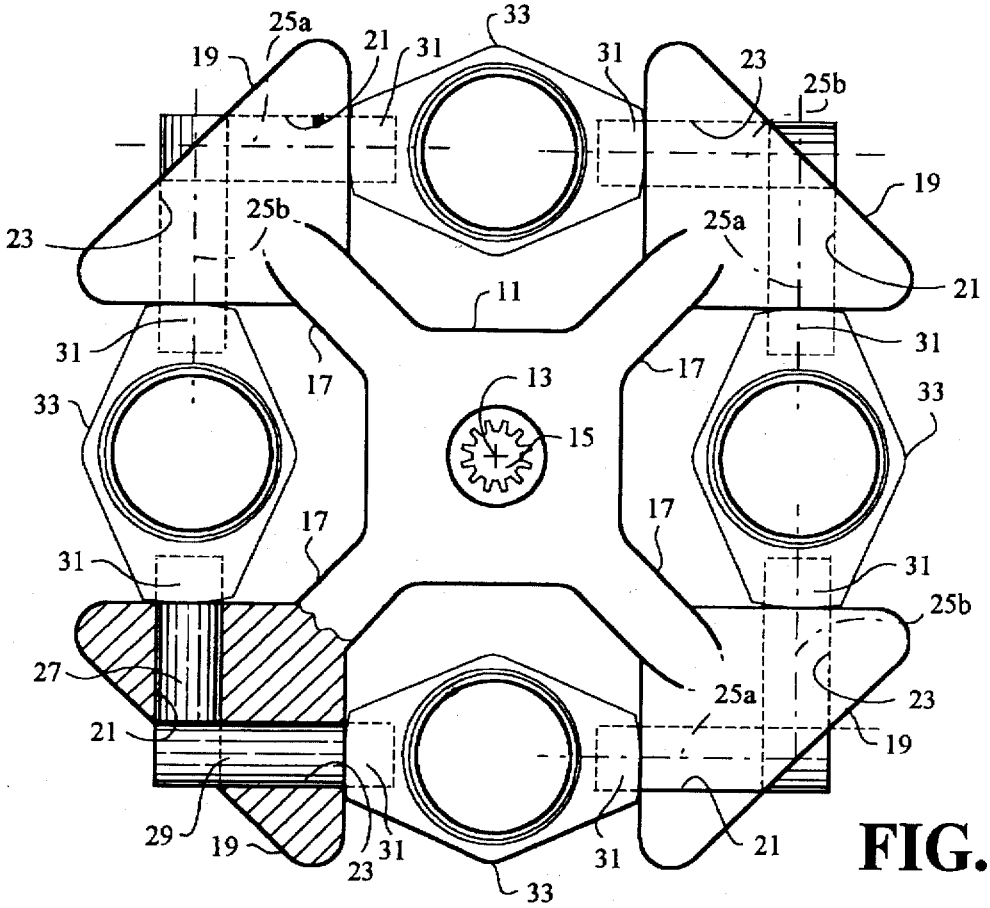
FIG. 2 is a top down view of a rotor having a swinging bucket attached thereto and in accord with the present invention.
Figure 5:
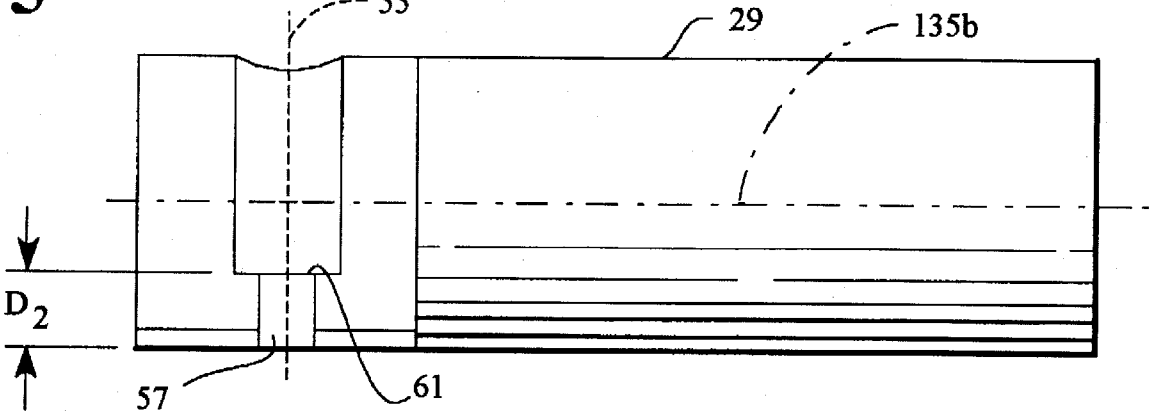
FIG. 5 is a plan view of one of the trunnion pins shown in FIG. 4, taken along lines 5—5.
Figure 6:
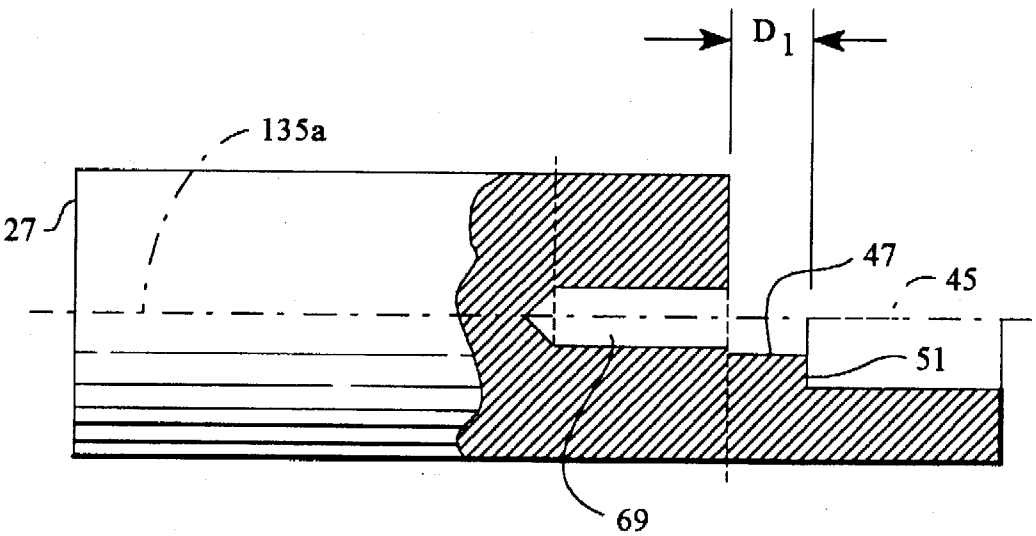
FIG. 6 is a side partial cross-sectional view of another trunnion pin shown in FIG. 4, taken along lines 6—6.

Referring to FIGS. 1 and 2, the rotor of the present invention includes a yoke 11 which has an axis of rotation 13 and is provided with a central hole 15 for mounting the rotor on an associated drive shaft. The rotor is provided with arms 17, each of which extends radially outward from the axis of rotation 13, terminating in a bulwark 19. Each of the bulwarks 19 includes two intersecting bores 21 and 23. The bores 21 and 23 are formed in each bulwark 19 so that the centerline of each lies on a plane which spreads perpendicular to the axis of rotation 13. The centerline of bores of adjacent bulwarks 19 are axially aligned.

Referring to FIGS. 1, 2 and 3, in each bulwark 19 the centerline 25*a* of bore 21 extends transverse to the centerline 25*b* of bore 23, forming an angle therewith. The bores 21 and 23 are disposed on opposite sides of the radial axis 17*a* of the arm 17, with the radial axis 13*a* bisecting the angle formed between the bores 21 and 23. The centerlines 25*a* and 25*b* of the bores 21 and 23 extend along a plane that spreads transverse to the axis of rotation 13. In this manner, the bores 21 and 23 intersect and form an aperture 19*a* in the bulwark 19 that is centered on the radial axis 17*a*. Each bore 21 and 23 extends from the aperture 19*a* and terminates in an opening 21*a* and 23*a*, respectively. A pair of trunnion pins 27 and 29 are associated with each bulwark 19. Trunnion pin 27 is inserted in bore 21, and trunnion pin 29 is inserted in bore 23. One end of each of the pins extends beyond the surface of the bulwarks 19 forming a trunnion portion 31. Specifically, trunnion portion 31 of trunnion pin 27 extends through opening 21*a*, and trunnion portion 31 of trunnion pin 29 extends through opening 23*a*. In this manner, trunnion portions 31 associated with adjacent bulwarks extend toward one another forming a trunnion adapted to support a swinging bucket or carrier 33. The carrier includes a slot which rides over the ends of the trunnion portion so that the carrier is pivotally attached thereto, with the buckets pivoting in a plane perpendicular to the axis of rotation, when the rotor spins about the axis of rotation.

Referring to FIGS. 2 and 4, each of the trunnion pins 27 and 29 typically includes a cylindrical body that extends along lengthwise axes 35*a* and 35*b*, respectively. Each of the trunnion pins 27 and 29 is stepped at one end, forming coupling portions 37*a* and 37*b*. In this fashion, each coupling portion 37*a* and 37*b* includes planar surfaces 39*a* and 39*b*, as well as shoulders 41*a* and 41*b*. The shoulder 41*a* extends transverse to the surface 39*a*, and the shoulder 41*b* extends transverse to surface 39*b*. When the trunnion pins 27 and 29 are disposed in the bulwark 19, the surface 39*a* of the coupling portion 37*a* of trunnion pin 27 faces the surface 39*b* of the coupling portion 37*b* of trunnion pin 29. This places the shoulder 41*a* of trunnion pin 27 against a side edge 29*c* of trunnion pin 29 and the shoulder 41*b* of trunnion pin 29 against the side edge 27*c* of trunnion pin 27. In this configuration, the lengthwise axes 35*a* and 35*b* of both trunnion pins 27 and 29, respectively, extend in a plane that spreads transverse to the axis of rotation 13. Thus, movement of the trunnion pins 27 and 29, radially outward from the axis of rotation 13, is precluded during centrifugation.

A problem encountered with this design concerned the displacement of the trunnion pins 27 and 29 during shipment to an end user. Although radial movement outwardly away from the axis of rotation 13 is precluded, axial movement parallel to the centerline of the bores was still possible. This proved problematic during shipment, considering that the trunnion pins 27 and 29 could be displaced from bores 21 and 23. To abrogate this problem, an interlocking mechanism is employed.

The interlocking mechanism includes a recess formed into each of the coupling portions 37*a* and 37*b*, as well as a coupling pin, discussed more fully below. Although the recesses may be of any shape desired, it is preferred that each recess is arcuate. This results in surfaces 39*a* and 39*b* being substantially planar, excepting the arcuate recess formed therein. Typically, each of the surfaces 39*a* and 39*b* lies in a plane that spreads transverse to the axis of rotation 13. The arcuate recess 43 of trunnion pin 27 extends from one end thereof, along a longitudinal axis 45, and is bifurcated into inner and outer portions 47 and 49. The inner portion 47 is formed closer to the surface 39*a* than the outer portion 49. A recessed shoulder 51 is formed between inner and outer portions 47 and 49. The longitudinal axis 45 extends parallel to, and is axially aligned with, the lengthwise axis 35*a* of trunnion pin 27, but is shown spaced-apart therefrom for clarity. The lengthwise axis 35*a* extends transverse to the lengthwise axis 35*b* of trunnion pin 29. Arcuate recess 53 of trunnion pin 29 extends across the extent of the diameter thereof, along a longitudinal axis 55. Similar to recess 43, recess 53 is bifurcated into inner and outer portions 57 and 59, forming a recessed shoulder 61 therebetween. The longitudinal axis 55 extends transverse to the lengthwise axis 35*b* of trunnion pin 29 and parallel to the lengthwise axis 35*a* of trunnion pin 27.

Referring to FIGS. 2, 3 and 4, when the trunnion pins 27 and 29 are disposed in the bulwark 19, as discussed above, recesses 43 and 53 are superimposed with one another, forming a cylindrical chamber 63 having an orifice 65. The greatest diameter of the chamber is measured between outer portions 49 and 59, with a narrower diameter measured between inner portions 47 and 57. Preferably, the orifice 65 is positioned proximate to aperture 19*a* of the bulwark 19, making the chamber 61 accessible from an exterior of the rotor. A coupling pin 67 is disposed within the chamber. The coupling pin 67 is adapted to rest within both recesses 43 and 53 upon being placed in the chamber 63. In this fashion, axial movement of the trunnion pins 27 and 29, parallel to the centerlines 25*a* and 25*b*, respectively, is hindered.

Referring to FIGS. 3, 4, 5 and 6, to secure the coupling pin 67 in the chamber 63, a threaded bore 69 is formed into trunnion pin 27. The threaded bore 69 extends from an end of the chamber 63 opposing orifice 65. The coupling pin 67 is typically a screw that includes a threaded portion 71 and a head 73. The threaded portion 71 has a diameter matching the narrower diameter. The head 73 has a diameter matching the greatest diameter. Although any type of screw may be employed, it is preferred that the coupling pin 67 comprise of a shoulder screw with an Allen-head.

Referring to FIGS. 2, 3, 5 and 6, the threaded portion 71 is adapted to thread into the threaded bore 69 a sufficient distance to allow the head 73 to seat against the recessed shoulder 51, when placed in a final seating position. It is preferred, however, that the head 73 be spaced-apart from shoulder 61 when placed in the final seating position. This prevents the coupling pin 67 from unthreading during operation of the rotor. Specifically, during operation, the container 33, mounted between trunnion portions 31, typically causes the trunnion pins 27 and 29 to rotate slightly about an axis extending parallel to their respective centerlines. The trunnion pins 27 and 29 rotate independent of each other, causing movement therebetween. Were head 73 secured against both shoulders 51 and 61, the independent rotation of trunnion pins 27 and 29 would tend to cause coupling pin 63 to back out from the threaded bore 69. To avoid this problem, the inner portion 47 extends along the longitudinal axis 45 a distance $D_1$ and the inner portion 51 extends along the longitudinal axis 55 a distance $D_2$, with $D_1$ being greater than $D_2$. An additional advantage with this structure is that the coupling pin 67 is subjected primarily to forces exerted tangential to the axis of rotation 13. This reduces the probability of failure due to fatigue, because the forces resulting from the aforementioned rotational movement are primarily exerted on the surfaces 37*a* and 37*b*.

Figure 7:
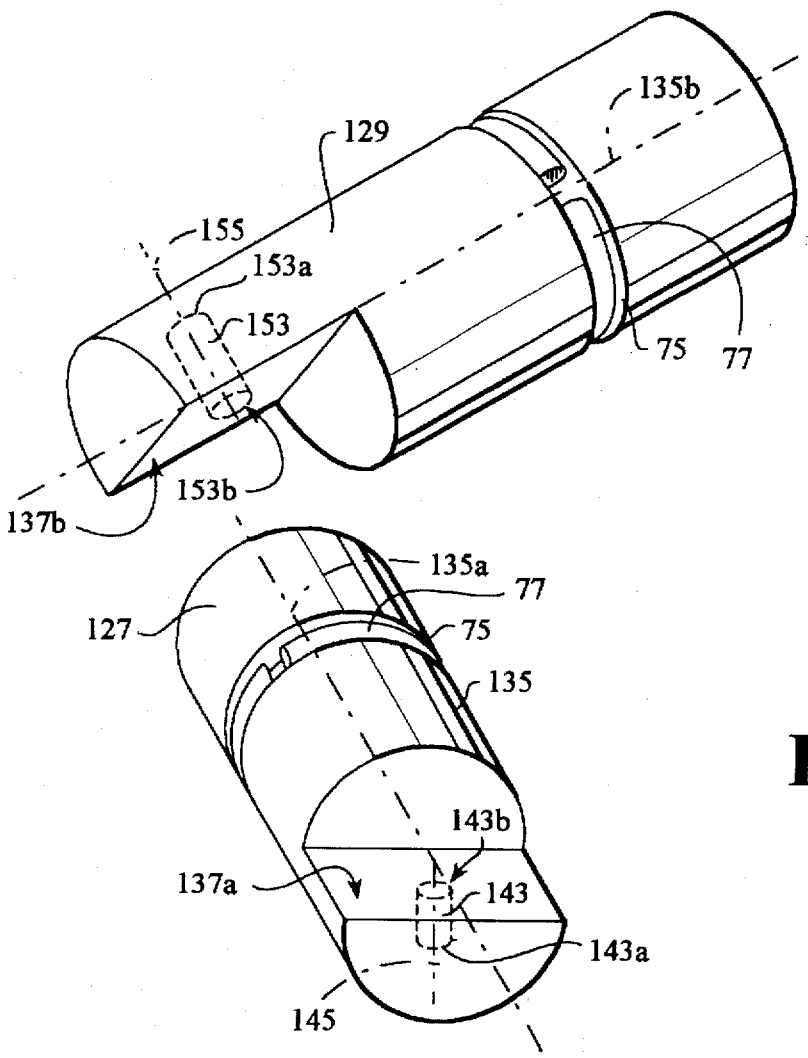
FIG. 7 is a perspective view of the trunnion pins shown in accord with an alternate embodiment.
Figure 8:
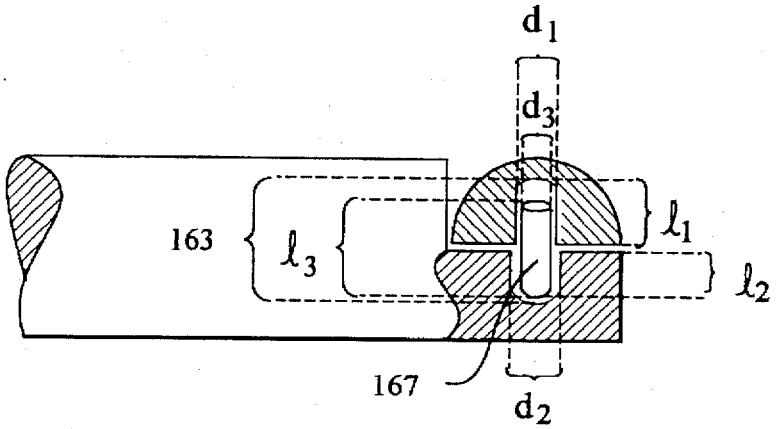
FIG. 8 is a partial cross-sectional view of the trunnion pins shown in FIG. 7, coupled together.

Referring to FIGS. 1, 7 and 8, an alternate embodiment of the coupling system is shown wherein the longitudinal axes 145 and 155 of recesses 143 and 153 are axially aligned and extend parallel to the axis of rotation 13, forming a chamber 163. Specifically, recess 143 extends from a closed end 143*a*, formed in the body of trunnion pin 127, along axis 145, terminating in an opening 143*b* that is disposed in surface 137*a*. Similarly, recess 153 extends from a closed end 153*a*, formed in the body of trunnion pin 129, along axis 155, terminating in an opening 153*b* that is disposed in surface 137*b*. In this manner, the longitudinal axes 145 and 155 extend parallel to the axis of rotation 13 and transverse to the lengthwise axes 135*a* and 135*b* of trunnion pins 127 and 129, respectively. Typically, both recesses 143 and 153 have a shape complementary to the shape of the coupling pin 167, discussed more fully below.

Recess 153 has a length $l_1$ as measured along longitudinal axis 155 and a diameter $d_1$, measured transverse thereto. Recess 143 has a length $d_1$, as measured along longitudinal axis 145, and a diameter $d_2$, measured transverse thereto. The diameter $d_2$ should be greater than, or equal to, diameter $d_1$, and $l_1$ must be greater than $l_2$. The coupling pin 167 may have any shape desired, e.g., a circular, hexagonal or octagonal cross-sectional area. Typically, the coupling pin 167 is cylindrical with a diameter $d_3$ and a length $l_3$. The diameter $d_3$ is slightly less than diameter $d_1$, with the length $l_3$ being greater than the $l_2$, but less than length $l_1$. In this fashion, the coupling pin 167 is allowed to move freely within the chamber 163, and between recesses 143 and 153.

Referring to FIGS. 2, 7 and 8, to install the trunnion pins 127 and 129, the coupling pin 167 is inserted into recess 153 so that gravity biases the same against closed end 153*a*. Trunnion pin 153 is then inserted into the bore 23 of the bulwark 19. The trunnion pin 127 is inserted into bore 21 of the same bulwark 19 so that recesses 143 and 153 are superimposed. The rotor is then orientated for operation so that gravity biases coupling pin 167 to rest against closed end 143*a*. In this manner, the trunnion pins 127 and 129 are less likely to detach from bulwark 19. Optionally, trunnion pins 127 and 129 may each include an annular groove 75 formed in the cylindrical body. A spring member 77 is disposed within the groove 75. To facilitate assembly, the spring member 77 may be disposed within the annular groove 75 so that it lies below the outer surface of the trunnion pins 127 and 129. When inserted into the bulwark 19, the spring member 77 is resiliently biased outwardly away from the annular groove 75, forming an interference fit between the trunnion pins 127 and 129 and the bores 21 and 23, respectively.

We claim:

1. A centrifuge rotor comprising:

a yoke;

a plurality of arms extending radially from said yoke, each of which terminates in a bulwark, said bulwark including a pair of intersecting bores;

a pair of trunnion pins associated with each said bulwark, each of said pair of trunnion pins being disposed in one of said pair of intersecting bores and including trunnion and coupling portions, with said coupling portion having a surface including a recess having a longitudinal axis, with the recess of each trunnion pin of said pair of trunnion pins being superimposed with one another, forming a chamber; and a coupling pin adapted to fit within said chamber and rest within the recess of each of said pair of trunnion pins.

2. The centrifuge rotor as recited in claim 1 wherein each of said pair of trunnion pins includes a lengthwise axis, defining first and second lengthwise axes, with said chamber extending transverse to said first lengthwise axis and perpendicular to said second lengthwise axis.

3. The centrifuge rotor as recited in claim 1 wherein each of said pair of trunnion pins includes a lengthwise axis, with said chamber extending transverse to the lengthwise axis of each of said pair of trunnion pins.

4. The centrifuge rotor as recited in claim 1 wherein each of said pair of trunnion pins includes a lengthwise axis, with the longitudinal axis of the recess of one of said pair of trunnion pins extending transverse to said lengthwise axis.

5. The centrifuge rotor as recited in claim 1 wherein each of said pair of trunnion pins includes a lengthwise axis, with said longitudinal axis of the recess of each of said pair of trunnion pins being axially aligned and extending transverse to said lengthwise axis, with one recess extending a greater distance than the remaining recess, defining long and short recesses, respectively, said coupling pin disposed within said chamber and having a length shorter than said long recess and greater than said short recess.

6. The centrifuge rotor as recited in claim 1 wherein each of said pair of trunnion pins includes a lengthwise axis, with said longitudinal axis of the recess of each of said pair of trunnion pins extending transverse to said lengthwise axis.

7. The centrifuge rotor as recited in claim 1 wherein each of said pair of trunnion pins includes a lengthwise axis, defining first and second lengthwise axes, with the longitudinal axis of the recess of one of said pair of trunnion pins extending transverse to said first lengthwise axis and perpendicular to said second lengthwise axis.

8. The centrifuge rotor as recited in claim 1 wherein each of said pair of trunnion pins includes a lengthwise axis, with the recess of each of said pair of trunnion pins being bifurcated into inner and outer portions forming a shoulder therebetween, with said inner portion of one of said pair of trunnion pins extending a greater distance along said lengthwise axis than the inner portion of the remaining trunnion pin of said pair of trunnion pins.

9. The centrifuge rotor as recited in claim 1 wherein one of said pair of trunnion pins includes a threaded bore extending from the recess associated therewith, with said threaded bore being axially aligned with said chamber.

10. The centrifuge rotor as recited in claim 1 wherein said trunnion portion has a cylindrical shape with a circumferential groove formed therein and a spring member disposed within said circumferential groove, with said circumferential groove adapted to be disposed within said bore and said spring member resiliently biased to press against said bore.

11. A centrifuge rotor comprising:

a yoke having an axis of rotation;

a plurality of arms extending radially outward from said axis of rotation, each of which terminates in a bulwark, said bulwark including a pair of intersecting bores each of which extends along a plane that spreads transverse to said axis of rotation;

a pair of trunnion pins associated with each said bulwark, each of said pair of trunnion pins being disposed in one of said pair of intersecting bores extending transverse to said axis of rotation, defining an axial direction, and including trunnion and coupling portions, with said coupling portion having a surface and a shoulder extending transverse thereto, said surface including a recess having a longitudinal axis, with the recess of each trunnion pin of said pair of trunnion pins being superimposed with one another, forming a chamber; and means, disposed within said chamber, for reducing translational motion of said pair of trunnion pins along said axial direction without substantially hindering rotational movement thereabout.

12. The centrifuge rotor as recited in claim 11 wherein one of said pair of trunnion pins includes a threaded bore, with said chamber having an orifice disposed proximate to the coupling portion of each of said pair of trunnion pins, with said chamber extending from said orifice, terminating proximate to said threaded bore, with said reducing means including a threaded member adapted to thread into said threaded bore.

13. The centrifuge rotor as recited in claim 12 wherein said recess of each of said pair of trunnion pins is bifurcated into inner and outer portions forming a shoulder therebetween, with said reducing means further including the inner portion of one of said pair of trunnion pins extending a greater distance along said longitudinal axis than the inner portion of said remaining trunnion pin of said pair of trunnion pins, defining an extended inner portion.

14. The centrifuge rotor as recited in claim 13 wherein said threaded member is a screw having a head adapted to seat against the shoulder formed between said extended inner portion and said outer portion, while being spaced apart from the shoulder of the remaining trunnion pin of said pair of trunnion pins.

15. The centrifuge rotor as recited in claim 11 wherein each of said pair of trunnion pins includes a lengthwise axis, with the longitudinal axis of the recess of each of said pair of trunnion pins extending transverse to said lengthwise axis, the recess of each of said pair of trunnion pins having a cross-section radially symmetric about said longitudinal axis.

16. The centrifuge rotor as recited in claim 15 wherein said trunnion portion has a cylindrical shape with a circumferential groove formed therein and a spring member disposed within said circumferential groove, with said circumferential groove positioned to be disposed within said bore and said spring member resiliently biased to press against said bore, upon said pair of trunnion pins reaching a final seating position.

17. A centrifuge rotor comprising:

a yoke having an axis of rotation;

a plurality of spaced arms extending radially outward from said axis of rotation, each of which terminates in a bulwark, said bulwark including a pair of intersecting bores each of which extends along a common axis lying in a plane extending transverse to said axis of rotation, with each of said pair of bores in each arm being aligned with one bore in an adjacent arm;

a pair of trunnion pins associated with each said bulwark, each of said pair of trunnion pins having a lengthwise axis and disposed in one of said pair of intersecting bores and including trunnion and coupling portions, with said trunnion portion extending outwardly from said bore toward a trunnion portion of an adjacent trunnion pin disposed in a bore of an adjacent arm, and said coupling portion having a planar surface including a recess, said recess having a longitudinal axis, with the recess of each trunnion pin of said pair of trunnion pins being superimposed with one another, forming a chamber; and a coupling pin adapted to fit within said chamber and rest within the recess of each of said pair of trunnion pins, thereby preventing translational motion of each of said pair of trunnion pins in a direction parallel to said common axis.

18. The centrifuge rotor as recited in claim 17 wherein one of said pair of trunnion pins includes a threaded bore extending from said chamber.

19. The centrifuge rotor as recited in claim 18 wherein the recess of each of said pair of trunnion pins is bifurcated into inner and outer portions forming a shoulder therebetween, with said inner portion of one of said pair of trunnion pins extending a greater distance along said longitudinal axis than the inner portion of said remaining trunnion pin of said pair of trunnion pins, defining an extended inner portion, with said coupling pin comprising a screw having a head adapted to seat against the shoulder formed between said extended inner portion and said outer portion, while being spaced apart from said shoulder of the remaining trunnion pin of said pair of trunnion pins.

20. The centrifuge rotor as recited in claim 17 wherein each of said pair of trunnion pins includes a lengthwise axis, with the longitudinal axis of the recess of each of said pair of trunnion pins extending transverse to said lengthwise axis, with said recess having a cross-section radially symmetric about said longitudinal axis, with one recess extending a greater distance than the remaining recess, defining long and short recesses, respectively, said coupling pin comprising a cylindrical pin, disposed within said chamber and having a length shorter than said long recess and greater than said short recess.

* * * * *